US005082215A

United States Patent [19]

Hutchison

[11] Patent Number: 5,082,215

[45] Date of Patent: Jan. 21, 1992

[54] DISPLAY BRACKET WITH LIVING HINGE

[76] Inventor: V. James Hutchison, 1949 S. Robb Way, Lakewood, Colo. 80227

[21] Appl. No.: 481,571

[22] Filed: Feb. 16, 1990

Related U.S. Application Data

[63] Continuation-in-part of Ser. No. 377,524, Jul. 10, 1989, Pat. No. 5,012,997.

[51] Int. Cl.[5] ..... A47G 29/10

[52] U.S. Cl. ..... 248/220.4; 40/657; 211/59.1

[58] Field of Search ..... 40/657, 642, 124.1; 248/220.3, 220.4, 221.1, 221.2; 211/54.1, 57.1, 59.1

[56] References Cited

U.S. PATENT DOCUMENTS

| | | | |
|---|---|---|---|
| 3,912,084 | 10/1975 | Valiulis . | |
| 3,977,109 | 8/1976 | Berry, Jr. et al. . | |
| 4,394,909 | 7/1983 | Valiulis et al. . | |
| 4,463,510 | 8/1984 | Windish . | |
| 4,525,944 | 7/1985 | Fast | 40/124.1 |
| 4,583,308 | 4/1986 | Taub . | |
| 4,646,454 | 3/1987 | Fast . | |
| 4,665,639 | 5/1987 | Fast . | |
| 4,693,024 | 9/1987 | Fast . | |
| 4,698,929 | 10/1987 | Fast . | |
| 4,703,570 | 11/1987 | Fast . | |
| 4,715,135 | 12/1987 | Fast | 40/642 |
| 4,773,172 | 9/1988 | Fast | 40/124.1 |
| 4,882,868 | 11/1989 | Fast | 40/642 |

FOREIGN PATENT DOCUMENTS

| | | | |
|---|---|---|---|
| 2726158 | 12/1978 | Fed. Rep. of Germany | 211/57.1 |
| 2585549 | 2/1987 | France | 40/642 |
| 9011588 | 10/1990 | PCT Int'l Appl. | 40/642 |

*Primary Examiner*—Gary L. Smith
*Assistant Examiner*—F. Saether
*Attorney, Agent, or Firm*—Timothy J. Martin; Dana S. Rewoldt

[57] ABSTRACT

An information display bracket is disclosed having a base portion for securing the information display bracket to the base of a product display bracket. An elongated arm extending over the product display bracket is pivotally secured to the base of the information display bracket at a proximal end by a living hinge and an information display plate is provided at a distal end extending past the end of the product display bracket.

24 Claims, 6 Drawing Sheets

DISPLAY BRACKET WITH LIVING HINGE

PRIOR APPLICATION

This application is a continuation-in-part of my earlier application, Ser. No. 07/377,524 filed 7-10-1989 entitled Information Display Bracket For Use In Pegboard Display Systems, now U.S. Pat. No. 5,012,997 issued May 7, 1991.

FIELD OF INVENTION

This invention relates to an information display bracket which can be used with a variety of different product support brackets in a product display system. Product display assemblies are used to display mechandise; the information display bracket is used to display information such as the selling price, the UPC, or item identification.

BACKGROUND OF THE INVENTION

Retail stores use a variety of methods to display merchandise. One technique is to use a product display system having a product support bracket that is mountable onto some type of a support panel. The support panel usually has a plurality of mounting holes extending through the panel for mounting the hanger assemblies. Although a variety of differing product support brackets and methods of attachment of those brackets to a support panel can be employed. There are two types of product support brackets that are specifically of interest. First, the hanger has a mounting base operative to be mounted onto the support panel and a product support arm that is connected to the mounting base and that extends forwardly of the front surface of the support panel. The product support arm terminates in a free end upon which the products for display can be hung. The mounting base is welded to the support arm. The product support bracket has a support arm that has a right angled portion. This right angled portion is welded to a crossbar from which rearwardly projects a pair of prongs that are designed to be mounted into the mounting holes in the support panel. In the second product support bracket of interest, there is a product support arm that is connected to a mounting base and the base has a plurality of rearwardly extending prongs and downwardly turned fingers that are designed to extend through the mounting holes in the support panel. The mounting plate also has a conical portion extending forwardly to an apex that extends into the product support arm. The information display bracket is provided to complete the product display system. The information display bracket is for providing readable display information about the merchandise located on the product support arm. A number of different tags have been developed to give this type of information. Many of thesse are designed so that the informtation display bracket rests on the product support arm in such a manner that it makes the removal of the displayed merchandise difficult.

SUMMARY OF THE INVENTION

It is an object of this invention to provide an information display bracket which pivots in relationship to said product support arm thereby providing easy access to the products and the merchandise displayed on the product support brackets.

A further object of this invention is to provide an information display bracket which can be installed without removing the product display bracket from the support panel.

Another objective of this invention is to provide an information display bracket with a base member which positively and resiliently engages the base of the product support bracket thereby resisting inadvertent dislodgment and displacement while maintaining a pleasing appearance.

An additional objective of the present invention is to provide an information display bracket that has a reinforced display arm that allows it to be resilient and to resist lateral deflection from lateral forces that maybe, encountered when products are removed from the combination information display bracket and product support arm.

A still further object of the present invention is to provide an information display bracket that can be easily manufactured and produced by rejection molding.

Yet another object of this invention is to provide an information display bracket that has a living hinge which allows the base member to be pivoted in the same vertical plane as a product display arm without material fatique.

A still further object of the present invention is to provide an information display bracket that can be unitarily molded by an injection molding process wherein the information display bracket avoids any undercuts so that the mold does not require slides, thus reducing mold costs. Permitting the information display bracket to be simply and efficiently manufactured by plastic injection molding procedures.

The present invention accordingly is directed to a product display system and, in particular, to an information display bracket for use with such a system. As is known, a standard product display system includes a support panel with a front and a back surface and a plurality of spaced apart mounting holes that extend through the front and back surfaces. One or more different types of product support brackets can be used with a variety of product display systems. In any event, the typical product support bracket is adapted to be matably engaged to the mounting holes in the support panel to mount the product support bracket on the support panel forwardly thereof in order to hold products or merchandise for display. To this end, the mounting base has at least one prong that is adapted to extend through a selected mounting hole and is operative to mount the mounting base to the support panel.

The information display bracket according to the broad form of the present invention includes a base member that is adapted to be positioned approximate to said mounting base, and the information display bracket also has fastening elements operative to fasten the base member in a fastened state relative to the support panel and the mounting base. Furthermore, the information display bracket has a display arm with a proximal end and a distal end. A living hinge structure interconnects the base member and the proximal end of the display arm to allow the display arm to freely pivot with respect to the base member in a vertical plane common therewith. The information display bracket has an information display plate at the distal end of the display arm. The display arm extends forwardly of the front surface of the support panel when the information display bracket is in the fastened state.

In one illustrative embodiment of the invention, the information display bracket is adapted to be positioned on a support panel having mounting holes in conjunction with the product support bracket. Here, the information display bracket has a base member configured as a base plate with opposite side edges having a hinged interconnection to a plurality of fastening ears. Each fastening ear include a lobe adapted to be operative to engage the base plate to the mounting holes thereby securely positioning and mounting the information display bracket on the support panel. This embodiment of the information display bracket is also designed to be easily manufactured without undercuts when an injection molding process is used. To that end the base plate of the information display bracket has side edges which are of a first thickness and has ears which are of a second thickness that are hingedly connected at a hinged interconnection which is a living hinge formed of a third thickness which is smaller than the first or the second thickness.

In another illustrative embodiment of this invention, the information display bracket has a base member that is hingedly connected to the display arm with the base member adapted to be mounted between the support panel and the mounting base of the product support bracket. The mounting base of the product support bracket here is formed of an arcuate crossbar that terminates into a pair of rearwardly projecting prongs which extend through the holes in the support panel. The arcuate crossbar and the pair of prongs define an opening bounded by the suport panel and the crossbar and the prongs. The base member of the information display bracket has a lower base section that includes lower base side edges that are adapted to be inserted into this opening and the lower base section also includes fastening structure to engage the prongs. The base member also has a flat upper base section that is pivotally connected by a living hinge to the proximal end of the display arm. The distal end of the display arm is connected to an information display plate.

In this second embodiment the lower base section has a slot that extends intermediately of the lower base section side edges. The slot forms two parallel legs, and the fastening structure includes one or more operative pairs of lateral cut-outs that are adapted to engage the prongs of the mounting plate. This slot is adapted to be squeezed together to snap fit the laternal cut-outs onto and off of the mounting base. The information display bracket has a secondary method of engaging the information display bracket in a positive relationship to the support panel and the product support bracket. To this end, the information display bracket has a lower base section that includes on each of its legs a web that projects forwardly of the base member. The web has a lower edge that is inclined so to allow the base member to be easily installed relative to the crossbar. The web acts as a brace against the crossbar to positively position said base member relative to said support panel and said mounting plate.

In either embodiment, the information display bracket has a display arm that preferably has a central rod portion, a proximal end constructed as a small flat triangular proximal section with divergent sides edges that are connected to the living hinge oppositely to the central rod section, and a distal rod end that is connected to the display arm's distal end. The display arm's distal end may include a flat triangular distal arm section that is connected to the information display plate and connected oppositely to the central rod portion. The distal arm section of the information display bracket is adapted to rest on the free end of the support arm and forms a strike plate for the information display bracket.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention relates to merchandise display systems and particularly to information display brackets which may be fit onto existing product support brackets which are mounted onto various support panels in order to display merchandise, products etc. These merchandise display systems are especially useful in the retail sales field.

Figure 1:
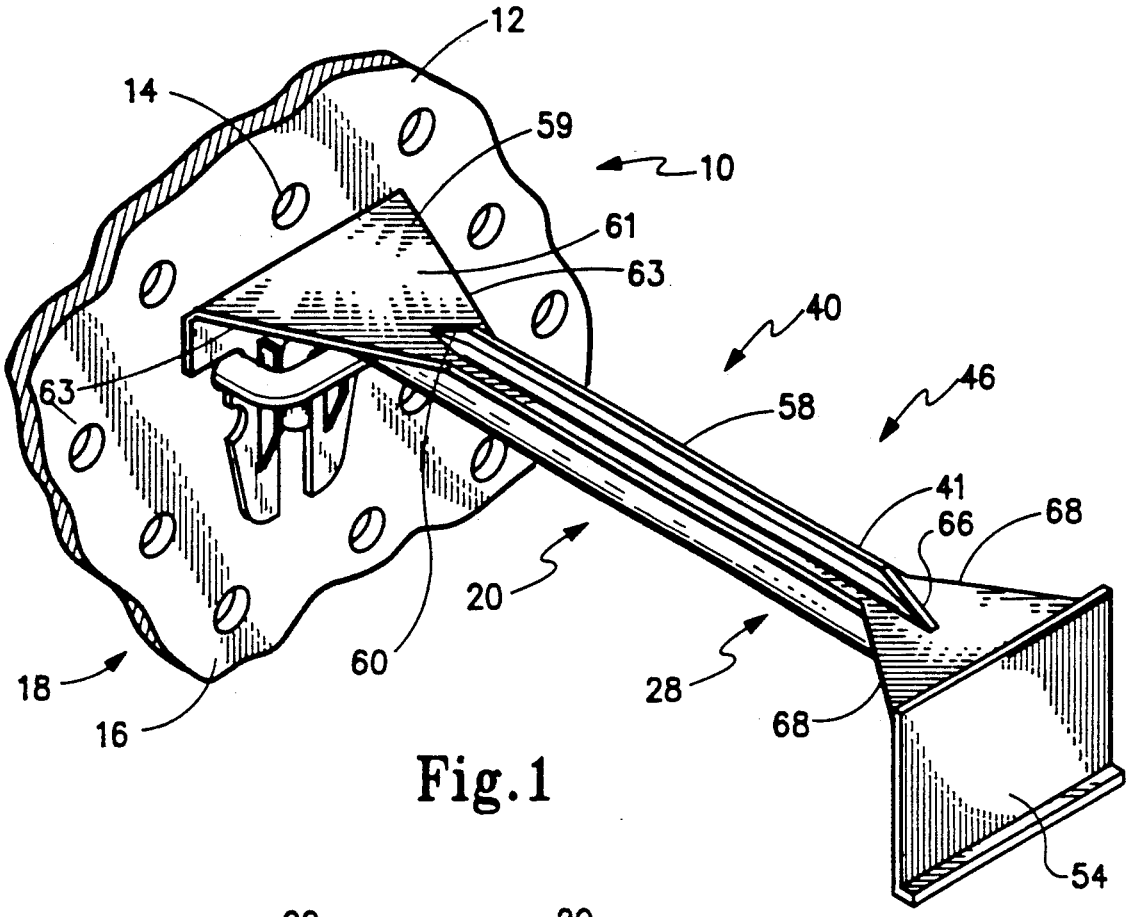
FIG. 1 is a perspective view of product display system showing a support panel, a prior art product support bracket, and an information display bracket according to the present invention.

Generally, product or merchandise display systems are well known in the industry and comprise an upright support panel which can be formed of such things as pegboard or metal with apertures in it to which product display brackets are releasably secured by means of mounting prongs that engage mounting holes in the panel. For example, FIG. 1 shows a merchandise display system 10 which is formed of an upright support panel 12 of the pegboard type having mounting holes 14 which extend through the front surface 16 thereof to the rear surface 18. The merchandise display system 10 has traditional product support brackets 20 that are mounted to support panel 12 in such a manner to hold products for display. The products are held forwardly from the front surface 16 of the support panel 12, on the product support arm 28.

Figure 2:
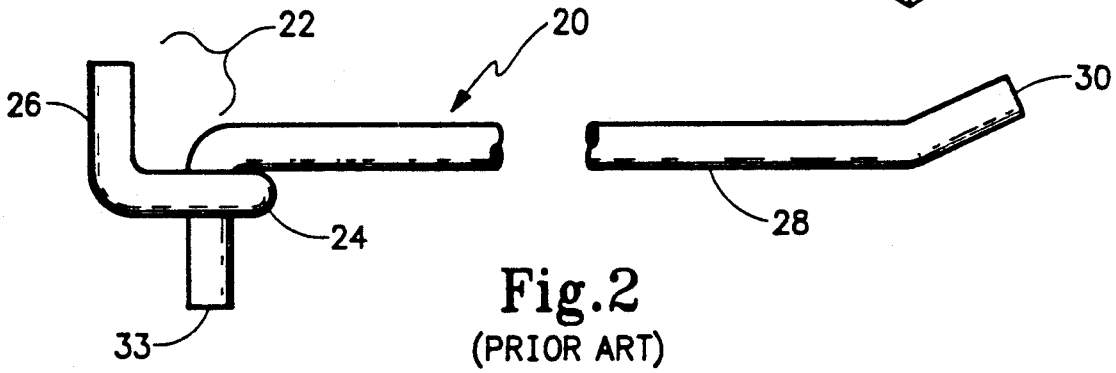
Fig.2 (PRIOR ART)
FIG. 2 is a side view in elevation of a prior art product support bracket used in the display system of FIG. 11.
Figure 7:
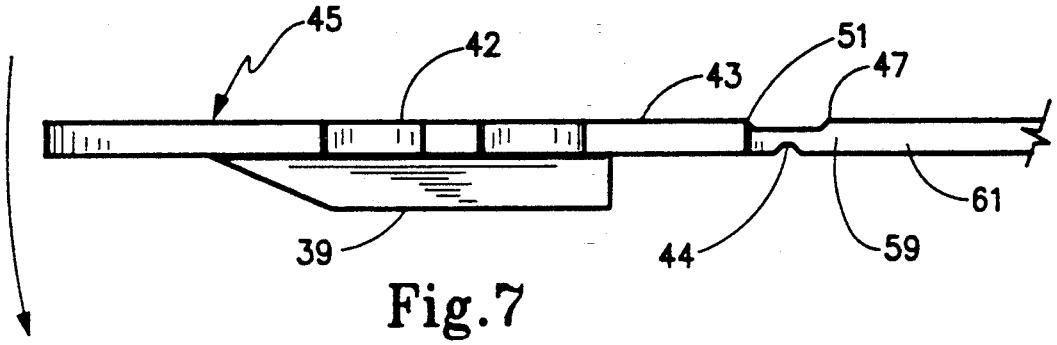
FIG. 7 is an enlarged side view in elevation of the base member and proximal end of the informetion display bracket of FIG. 3.
Figure 3:
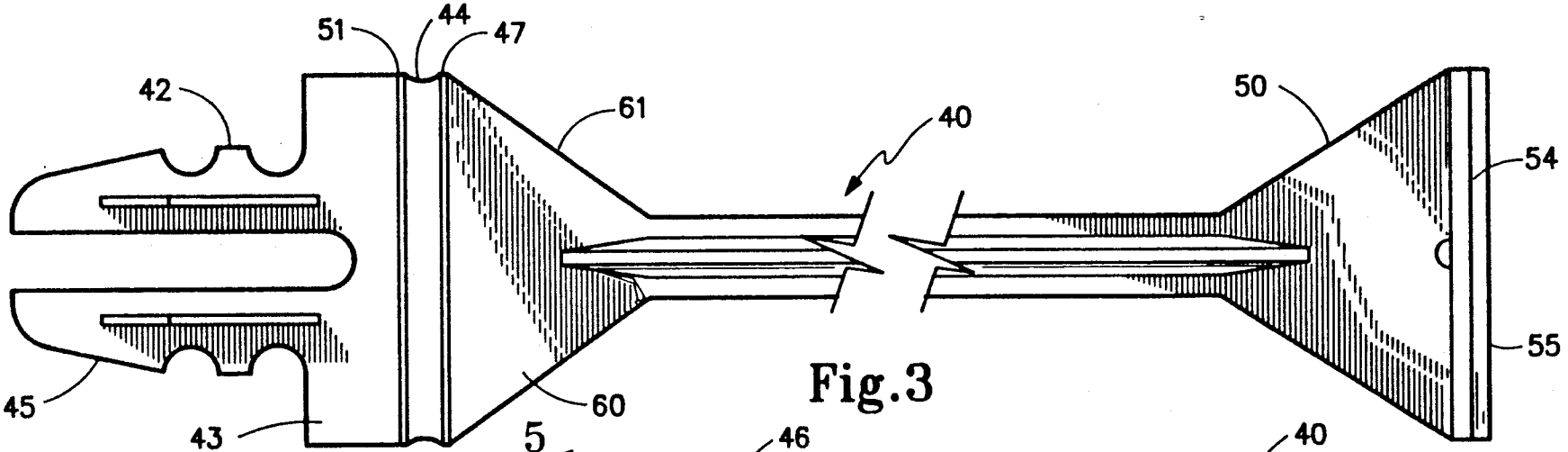
FIG. 3 is a bottom plan view of the information display bracket shown in FIG. 1 having the mounting base in the same plane as the information display bracket.
Figure 4:
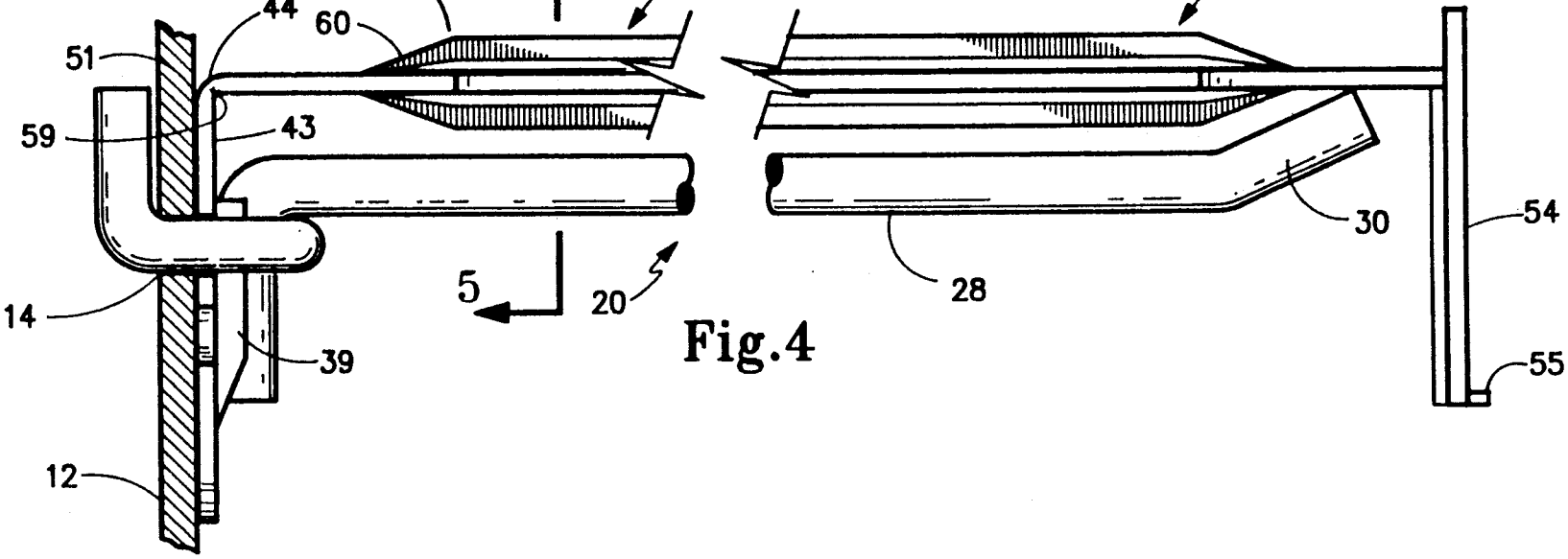
FIG. 4 is a side view of the prior art product support bracket of FIG. 2, and the information display bracket according to the present invention as installed in the display system.

Also provided in this product display system 10 is an information display bracket 40 according to one exemplary embodiment of the present invention. Display bracket 40 is provided to display information, such as price information, inventory information, descriptive information, etc., that is correlated to the various packaged items that are being held on the product display brackets 20. The product support bracket 20 with which the information display bracket 40 is employed is best shown in FIG. 2. The mounting of these brackets, 20 and 40 to the support panel 12 is best shown in FIGS. 3 and 4.

Turning to FIGS. 1, 2 and 4–6, it may be seen that the prior art product support bracket 20 specifically includes a mounting base 22 which is positionable relatively adjacent to the front surface 16 of the support panel 12. The product support bracket's 20 mounting base 22 has at least one but preferably two prongs 26 that are adapted to extend through the mounting holes 14 and that are operative to mount the mounting base 22 to the support panel 12 in a mounted state seen in FIGS. 1 and 4.

Mounting base 22 includes a crossbar 24 from which prongs 26 rearwardly project. When the prongs 26 are mounted in the support panel 12 the crossbar 24 is positioned forwardly of the front surface 16 in the mounted state. In this mounted state the arcuate crossbar 24 and support panel 12 bound an open region 32. The product support bracket 20 includes a product support arm 28 that extends forwardly of mounting base 22. The product support arm 28 terminates in a free end 30 forwardly of front surface 16 when the product support bracket 20 is in the mounted state on the support panel 12 as is shown in FIG. 1. Products may be received and supported for display on the product support bracket 20 and specifically on the product support arm 28.

It is often the case that the retailer desires to display information regarding the product supported on the product support bracket 20. To this end, the present invention incorporates the information display bracket 40. Information display bracket 40 is adapted to be fastened relative to and in conjunction with the support panel 12 and the product support bracket 20 when the product support bracket 20 is in the mounted state. A first exemplary embodiment of the information display bracket 40 shown in FIGS. 1 and 3–7, includes a base member 42, a display arm 46 and an information display plate 54. The information display bracket 40 is usually constructed of an integral piece of plastic by injection molding or like processes, whereby the proximal end 60 of display arm 46 is interconnected hingedly to the base member 42. The display arm 46 has a distal end 50 which is connected to the information display plate 54 which includes a lip 55 that serves to align and support an information card, label and the like to be displayed thereon. The structure that hingedly interconnects the proximal end 48 of display arm 46 with a base member 42 is a living hinge 44 best illustrated in FIG. 5.

Figure 5:
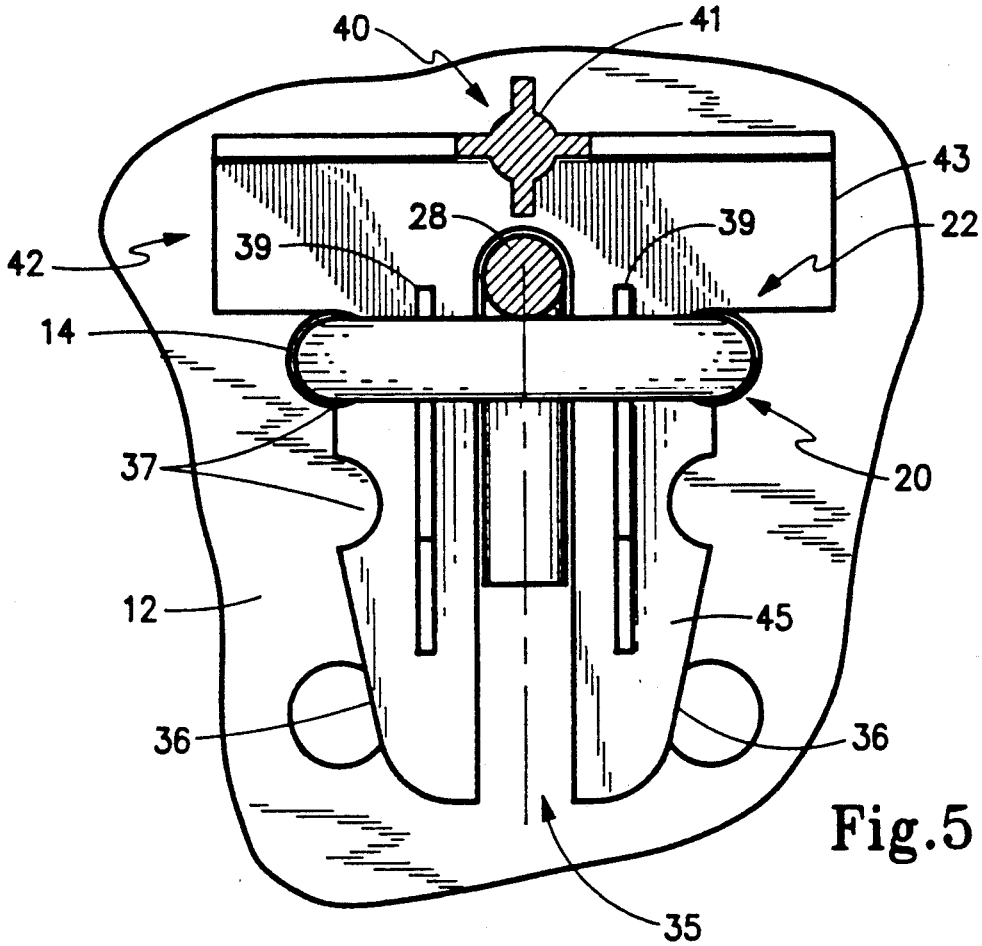
FIG. 5 is an end view in cross-section taken about lines 5—5 of FIG. 4.

The base member 42 is adapted to be positioned proximate to the mounting base 22 of the product support bracket 20 in open region 32. Base member 42 has an upper base section 43 and a lower base section 45 each having a first thickness. The proximal end 60 of the display arm 46 is formed as a flat proximal arm section 61 having a second thickness. A living hinge structure 44 interconnects the upper base section 43 and the proximal arm section 61 respectively along the proximal edge 47 and the upper edge 51. As seen in FIG. 5 the first thickness of the base member 42 is greater than the second thickness of the flat proximal arm section 49. The living hinge 44 which interconnects the two is formed of a strip of reduced thickness material having a third thickness which is a lesser thickness than the first and second thickness. Hinged interconnection between the base member 42 and the proximal end 60 of the proximal arm section 61 permits the display arm 46 to freely pivot with respect to the base member 42. Furthermore the living hinge 40 facilitates the process of mounting the information display bracket 40 onto the product support bracket 20.

Figure 6:
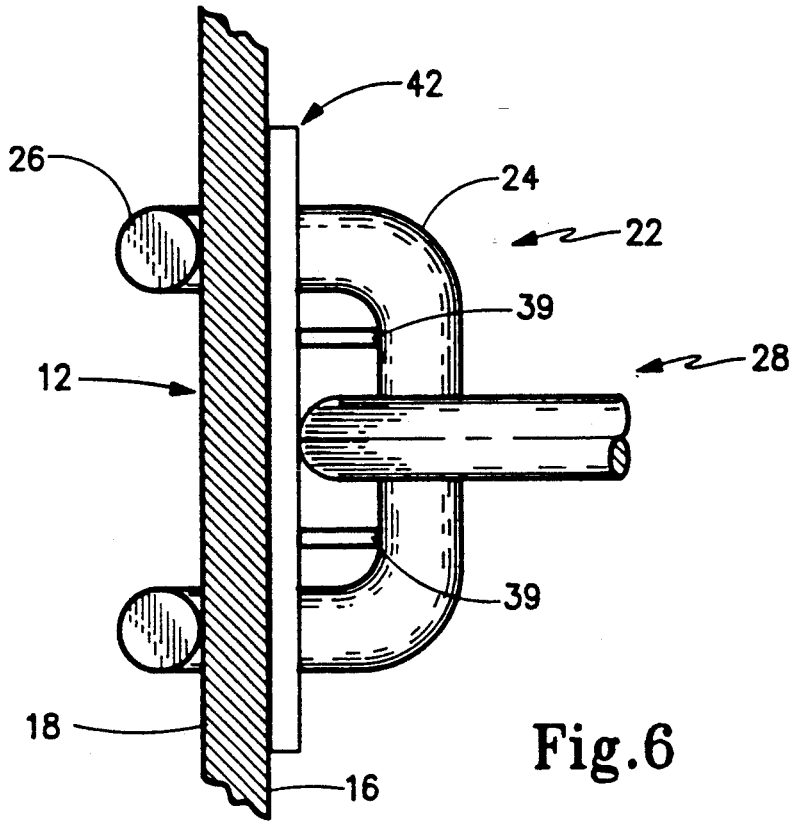
FIG. 6 is a top plan view showing the mounting base and the base member of the product support bracket and information display bracket of the display system of FIG. 5.

A problem associated with various different merchandise display systems of the type shown in FIG. 1 is the tendency of the product display brackets to dislodge from their mounted positions. In addition, where information display brackets are used, they can also likely to become dislodged. If the product support bracket 20 has a mounting base 22 that has a crossbar 24 which rearwardly projects a pair of spaced apart prongs 26 that are adapted to extend through a spaced pair of mounting holes 14 on the support panel 12 then the information display bracket 40 of the present invention can be employed to eliminate the aforementioned problems. As best depicted in FIGS. 4–6 lower base section 45 has a base section side edges 36 that are adapted to interposed between the front surface 16 and the crossbar 24. To securely engage the base member 42 on the support panel 12 and the mounting base 22 the base member 42 has fastening means such as a first pair of lateral cut-outs 37 that are operative to engage the prongs 26 on opposite sides of the base member 42. There is at least one pair of lateral cut-outs 37 on the opposite sides edges 36 of the base member 42; however, there can be additional pairs of cut-outs to allow adjustability of spacing between the product support bracket 20 and the information display bracket 40. To further lock base member 42 in opening 32, a pair of spaced apart webs 39 are located on lower base section 45. The webs 39 extend forwardly from the base member 42 and are operative to wedge against the crossbar 24. The lower edge of the webs 39 on the lower base section 45 are inclined so that the crossbar 24 will be progressively moved away from the front surface 16 of the support panel 12 when the base member 42 is progressively interposed therebetween. Therefore permitting the information display bracket 40 to be easily and efficiently inserted between the product support bracket 20 and the support panel 12 without undue resistance.

Mounting base 22 has a vertical rod section or foot 33 formed as a down turned extension of arm 28. To accommodate foot 33, lower base section 45 has a slot 35 that extends substantially parallel and intermediately of the lower base section side edges 36 whereby the lower base section 45 is formed into two parallel legs 29. Slot 35 is sized to receive the foot 33 when the information display bracket 40 is in the fastened state so that foot 33 does not interfere with positioning of the mounting base 22. Legs 29 defined by slot 35 can also be slightly deflected together in such a manner that the lateral cutouts 37 may be released from prongs 24 during mounting and removal.

Maintaining a neat appearance of the merchandise display unit can be simplified if the display arm 46 can not be easily deflected out of proper alignment with the product display bracket 20. Therefore, the present invention is designed to have a sufficiently strengthened resilient rod portion 41. Rod portion 41 includes a proximal rod end 60 connected to a proximal end 59 configured in the form of a triangular proximal arm section 61 having proximal arm section side edges 63 which are divergent from one another in a direction from the proximal rod end 60 to said proximal edge 47. The rod portion 41 has a rod diameter which is greater than the second thickness that defines the thickness of the proximal arm section 61 as previously described. The greater thickness of the rod helps maintain the information display bracket 40 in a parallel spaced apart relationship with the product support arm 28, and further supports the display plate 54 connected to the information display arm 46 in the correct position on the product display system 10. Rod portion 41 also has reinforcing ribs 58 that extend longitudinally thereof at equiangularly spaced circumferential locations therearound.

Display arm 46 has a distal end 50 of the display arm 46 located oppositely of living hinge 44, and this distal end 50 is formed of a flat distal arm section 64 connected to a distal rod end 66 of the rod portion 41. Distal end section 64 is triangular in shape and has divergent side edges 68 operative to define a strike plate 70. Display arm 46 is sized so that the information display plate 54 is positioned forwardly of the free end 30 of the product support arm 28 with the strike surface 70 resting on the free end 30 when in a fastened state.

From the foregoing, it should be readily seen that information display bracket 40 provides a highly useful and efficient means for retro-fitting existing merchandise display systems 10. The time and cost of replacing all product support bracket with a built in combination information/support bracket is eliminated upon the use of the present invention which simply retrofits each product support bracket 20 with an information display bracket 40. Further, to install these information display brackets 40 is not necessary to remove the merchandise or the product support bracket 20 from the support panel 12 to insert the information display bracket 40.

In the first exemplary embodiment of this invention the base member 42 includes elements operative to fasten the base member 42 in place, these elements are located on the lower base section side edges 36 of the base member 42. It should be understood and appreciated by those skilled in this field of invention that the fastening means can differ according to the display system involved. A feature to note, however, is that the information display bracket 40 can be molded by a plastic injection process. As a result of using the living hinge structure a dual advantage is obtained which advantage is not believed to have heretofore been recognized. Not only does the living hinge allow easy removal of products from the display to which information display bracket is fastened while maintaining resistance to lateral displacement, but also, the living hinge allows base member 42 to be molded in a common plane with proximal arm section 61. This permits a relatively inexpensive mold to be employed since the shape, in this orientation, eliminates all undercuts which would otherwise require expensive molds incorporating slide elements to form the undercuts.

Figure 8:
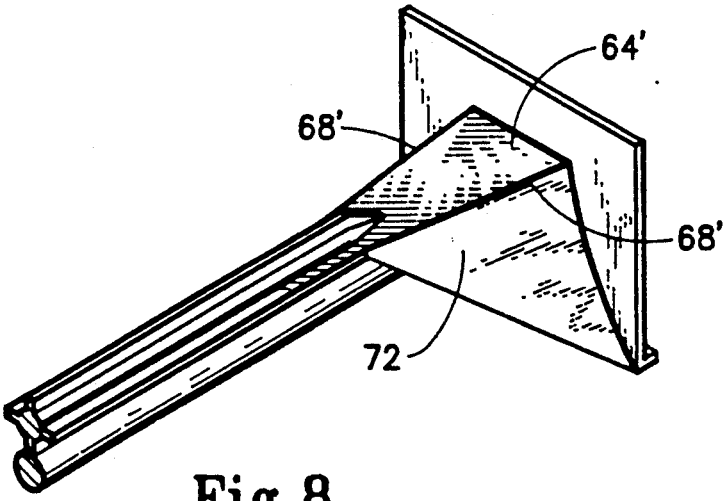
FIG. 8 is a rear perspective view of an alternate construction of the information display plate of the information display bracket according to the present invention.
Figure 9:
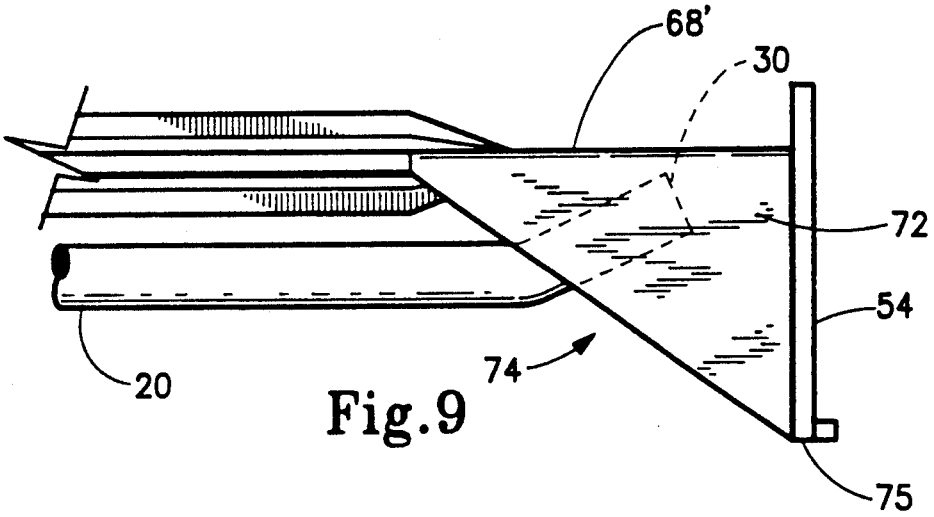
FIG. 9 is an side view in elevation of the information display plate of FIG. 8.
Figure 10:
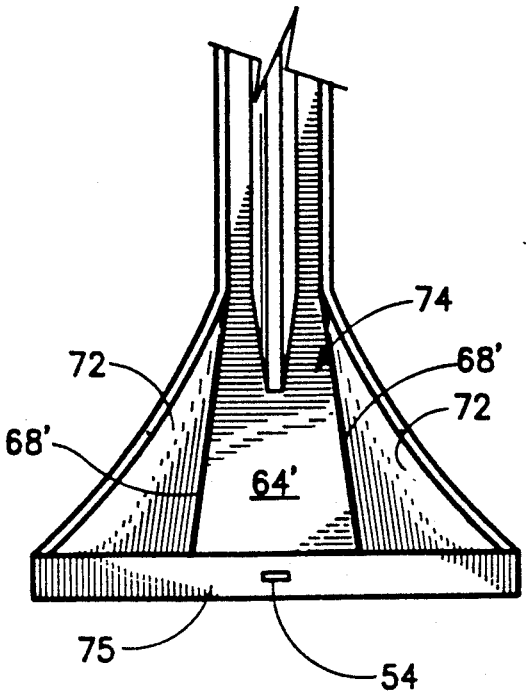
FIG. 10 is a bottom plan view of the information display plate of FIGS. 8 and 9.

An enhancement of the strike plate feature defined by distal end section 64 is shown in FIGS. 8–10. Here, a pair of downwardly depending wings 72 are formed on the underside of distal end section 64'. Wings 72 each extend along a respective side edge 68' so that they are forwardly divergent from one another, although it may be noted that the angle of divergence of edges 68' is smaller than the angle of divergence of edges 68', above. Wings 72 are also downwardly divergent with each having an arcuate shape thereby creating a generally pyramidal cavity 74 operative to capture the free end 30 of product support arm 20. When product is removed from support arm 20, wings 72 act to ramp information display plate 54 away from free end 30 to disengage free end 30 from cavity 74. To this end, wings 72 terminate along a lower edge 75 of information display plate 54. After removal, this configuration automatically centers end 30 in cavity 74, thus protecting free end 30 and maintaining a pleasing appearance. Again, with this structure, no undercuts are present during molding.

Figure 11:
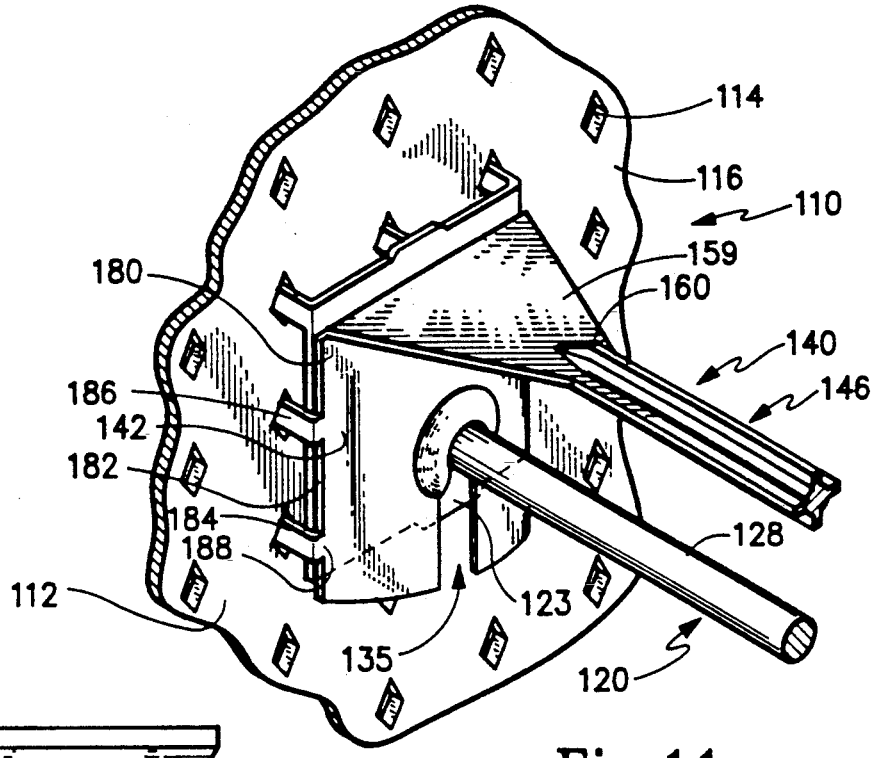
FIG. 11 is a perspective view of a second type of merchandise display system incorporting the present invention and showing a different type of support panel along with a base section of a different product support bracket corresponding thereto and a base portion of an information display bracket according to an alternative embodiment of the present invention.
Figure 13:
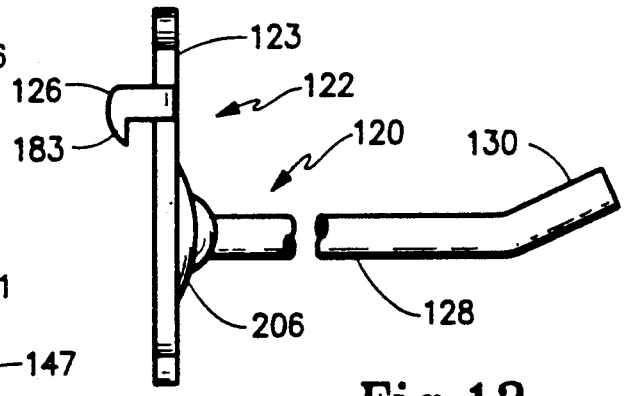
Fig.13 (PRIOR ART)
FIG. 13 is a side view in elevation of the prior art information display bracket used in the system shown in FIG. 11.
Figure 14:
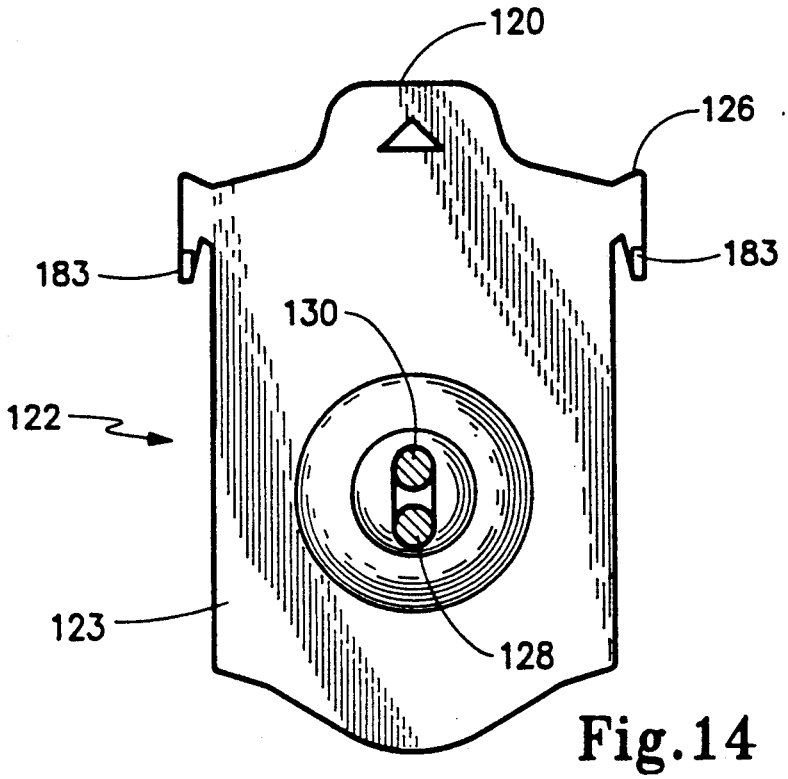
FIG. 14*a* is a front end view of the product support bracket of FIG. 13.

An alternate embodiment is adapted to be employed in a slightly different merchandise display system as seen in FIG. 11. Here, the merchandise display system 110 is comprised of an upright support panel 112 having diamond shaped mounting holes 114 into which the product display bracket 120 shown in FIG. 13 and 14 is releasably secured. To this end, the product display bracket 120 has a mounting base 122 configured as a mounting plate 123 with a conical portion 200 having an apex from which a product display arm 128 extends to a free end 130. The mounting plate 123 is relatively flat and has a plurality of rearwardly extending prongs 126 having downwardly turned fingers 183 that are operative to extend through the mounting holes 114 to connect bracket 120 to panel 112.

Figure 12:
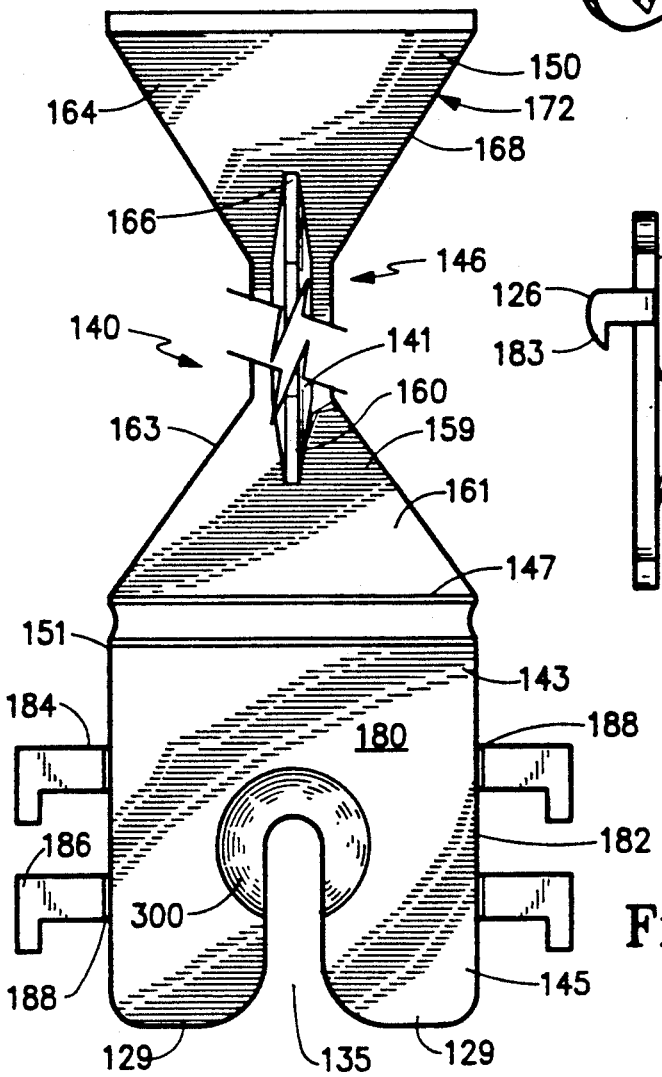
FIG. 12 is a top plan view of the alternate information display bracket with the mounting of the base plate in the same horizontal plane as the display arm.
Figure 15:
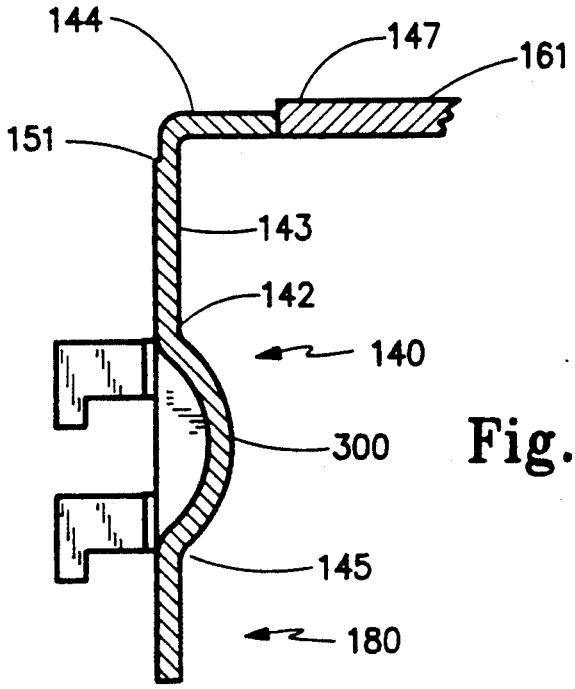
FIG. 15 is a side view in cross-section of the proximal end and base member of the information display bracket shown in FIG. 12.

An alternate information display bracket 140, seen in FIGS. 12 and 15 is adapted to be fastened relative to with the support panel 112 and the product support bracket 120 when the product support bracket 120 is in the mounted state. The information display bracket 140 has an alternative base member 142 connected to a display arm 146 having a display plate 154 connected on the distal end 150. Display arm 146 is connected to a base member 142 by a living hinge 144 proximal arm section 161. The living hinge 144 permits products to be removed from the product support arm of the product display bracket 120 by pivoting the display arm 146 upward and away from the product support arm 128. The display arm 146, due to the hinge structure, can pivot through a large angle relative to the base member 142 when in an unmounted state. The living hinge 144 is adapted to withstand rotation without undue stress on the plastic material forming the hinge. In the mounted position display arm 146 rests at approximately a 90° angle to the support panel 112, however, it can be pivoted upwardly or downwardly to a position approximately parallel to the support panel 112. The mobility of the display arm 146 provides easy access to the products on the product support arm 128.

Similarly to the first information display bracket described the display arm 146 is formed of a rod 141 having reinforcing ribs spaced at equiangular distances around the circumference central rod's 141. The central rod 141 has a proximal rod end 160 connected to the proximal end 159 which is configured as a first triangular proximal arm section 161 with divergent side edges 163. The distal rod end 166 of the central rod 141 is connected to the distal end portion 150 configured as a second triangular distal arm section 164 with divergent side ends 168 operative to define a strike plate 170. The strike plate 170, if desired, can have downwardly depending wings similar to the embodiments shown in FIGS. 8-10.

The primary distinction between the first and second embodiment lies in the base member 142. The second embodiment is most clearly shown in FIGS. 11, 12, and 15. The alternative embodiment includes the base member 142 which includes a base plate 180 sized to overlay the mounting plate 123, side edges 182 having fastening elements which can be formed as a plurality of ears 184 and lobes 186 which are connected to the base plate 180. The side edges 182 are a first thickness. The ears 184 are formed of a second thickness. The ears 184 are hingedly connected to the side edges 182 each by a living hinge structure 188 formed of a third thickness that is smaller than the first thickness and the second thickness. The ears 184 and the lobes 186 are operative to engage selected mounting holes 114 in the support panel 112. The living hinge structures 188 associated with the fastening elements permits the base plate 180 to be securely positioned relative to the support panel 112.

The base plate 180 has an upper base section 143 with an upper edge 151 that is connected to the proximal edge 147 by the living hinge 144. Further, the base plate 180 has lower base section 145 that includes a downwardly opening longitudinal slot 135 located between and substantially parallel to the side edges 182 of the base plate 180. The slot 135 is oriented to engage the product support arm 128 whereby the base plate 180 is securely positioned in an abutting relationship to the mounting plate 123 and is supported by the product support bracket 120. To further position the base plate relative to the mounting plate 123 the base plate 180 has a complementary concavity 300 sized and located to engage the conical portion 200 of the mounting plate 123 when the base plate 180 overlays the mounting plate 123 in an abutting relationship.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the spirit of the invention of the inventive concepts contained herein.

I claim:

1. In a product display system wherein a support panel has a front surface and a back surface and a plurality of spaced-part mounting holes extending therethrough and wherein product support brackets are mountable on said support panel in order to hold products thereon for display, each said product support bracket including a mounting base to be positioned adjacent said front surface, at least one prong adapted to extend through a selected mounting hole and operative to mount said mounting base to said support panel in a mounted state and a product support arm connected to said mounting base and extending forwardly of said front surface, said product support arm terminating in a free end when said product support bracket is in the mounted state whereby products may be received and supported for display on said product support bracket, the improvement comprising an information display bracket adapted to be fastened relative to said support panel and said product support bracket when said product support bracket is in the mounted state, said imformation display bracket including a base member formed with a selected first thickness adapted to be positioned proximate said mounting base, fastening means for fastening said base member in a fastened state relative to said support panel and said mounting base, a display arm formed with a selected second thickness and having a proximal end and a distal end, a living hinge structure formed with a selected third thickness less than both the first and second thicknesses, said living hinge structure interconnecting said base member and the proximate end of said display arm whereby said display arm may freely pivot with respect to said base member, and an information display plate at the distal end of said display arm, said display arm extending forwardly of said front surface in the fastened state.

2. The improvement according to claim 1 wherein said base member has a flat upper base section having said first thickness and defining an upper edge and wherein said proximal end of said display arm is formed as a flat proximal arm section having said second thickness and defining a proximal edge, said hinge structure interconnecting said upper base section and said proximal are section respectively along said upper and proximal edges.

3. The improvement according to claim 2 wherein said display arm includes a rod-like central arm having a proximal rod end connected to said proximal arm section, said proximal arm section having proximal arm section side edges which diverge from one another in a direction from said proximal rod end to said proximal edge whereby said proximal arm section is triangular in configuration said rod having a rod diameter greater than said second thickness.

4. The improvement according to claim 3 including reinforcing ribs extending longitudinally of said central arm at equiangular spaced circumferential locations therearound.

5. The improvement according to claim 3 wherein said display arm include said distal end of said display arm is formed as a flat distal arm section connected to a distal rod end of said central arm, said distal arm section having distal arm section side edges diverging from one another from said distal rod end to said distal end whereby said distal arm section is triangular in configuration to define a strike plate, said display arm sized so that said information display plate is positioned forwardly of said free end with said strike plate resting on said free end.

6. The improvement according to claim 5 wherein said distal arm section includes a pair of downwardly depending wings defining a cavity operative to receive said free end, each of said wings having a lower wing edge which extends longitudinally at an acute angle from said distal rod end to an information plate lower edge.

7. The improvement according to claim 6 wherein said pair of wings laterally diverge from one another whereby the cavity has a pyramidal configuration.

8. The improvement according to claim 1 wherein said mounting base of said product support bracket includes a crossbar from which rearwardly projects a pair of spaced-apart prongs adapted to extend through a spaced-pair of mounting holes in said support panel so that said crossbar is positioned forwardly of said front surface in the mounted state, said base member having a lower base section having lower base section side edges and adapted to be interposed between said front surface and said crossbar, said fastening means including a first pair of lateral cut-outs operative to engage said prongs on opposite sides of said base member.

9. The improvement according to claim 8 wherein said lower base section includes a pair of spaced-apart webs extending forwardly of said base member and operative to abut against said crossbar to move said crossbar away from the front surface of said support panel.

10. The improvement according to claim 9 wherein each of said webs has a lower edge inclinded with respect to said lower base section whereby said crossbar will be progressively moved away from the front surface of said support panel when said base member is progressively interposed therebetween.

11. The improvement according to claim 8 wherein said lower base section has a slot extending parallel to and intermediately of said lower base section side edges whereby said lower base section is formed into two parallel legs.

12. The improvement according to claim 11 wherein said product support arm has a foot portion depending downwardly at a proximal location to said mounting base such that said foot portion is located between said crossbar and the front surface of said support panel when said product support bracket is in the mounted state, the slot in said lower base section being sized to receive said foot portion when said information display bracket is in the fastened state.

13. The improvement according to claim 8 wherein said fastening means includes a plurality of pairs of lateral cut-outs along the lower base section side edges whereby said base member may be adjustably positioned with respect to said mounting base.

14. The improvement according to claim 1 wherein said mounting base comprises a mounting plate adapted to be positioned against the front surface of said support panel, said mounting plate including a plurality of rearewardly extending prongs having downwardly turned fingers operative to extend through selected ones of the mounting holes, said base member including a base plate sized to overlay said mounting base in abutting relation thereto, said base plate having a pair of side edges and a lower section separated into two downwardly depending legs by a slot intermediate of the side edges, the slot being sized to engage said product support arm, said fastening means including mounting ears located on said side edges and including lobes operative to engage selected ones of the mounting holes.

15. The improvement according to claim 14 wherein each of said mounting ears is hingedly connected to its respective side edge.

16. The improvement according to claim 14 wherein said mounting plate has a conical portion extending forwardly thereof to an apex, said product support arm extending forwardly from said apex, said base plate having a complementary concavity sized to and located to receive said conical portion.

17. The improvement according to claim 1 wherein said information display plate includes a forwardly extending lip formed along a lower edge thereof.

18. An information display bracket adapted to be used in conjunction with a product support bracket having a product support arm and a mounting base for mounting on a support panel having a plurality of mounting holes extending therethrough, said mounting base having a crossbar terminating in a pair of rearwardly projecting prongs sized and positioned to extend through respective mounting holes in said support panel so that said product support arm extends forwardly of said support panel to terminate in a free end when in the mounted state, said information display bracket comprising:

a base member having an upper base section having a first thickness and a lower base section sized to be inserted between said crossbar and said support panel when said product support bracket is in the mounted state and including fastening means on lower side edges thereof operative to engage said prongs on either side of said lower base section;

a display arm having a central rod portion including a distal end and a proximal end pivotally attached to said upper base section having a second thickness by a living hinge selectively formed of a thickness less than that of the first and second thicknesses and operative to permit relative pivotal movement of said display arm with respect to said base member such that said display arm may pivot in a vertical plane containing said product support arm in such manner that mechanical fatigue between said base member and said display arm is reduced; and an information display plate attached to the distal end of said display arm, said display arm sized such that said information display plate is positioned forwardly of the free end of said product support arm.

19. An information display bracket in accordance with claim 18 wherein said lower base section has a slot intermediate to said lower base section side edges to form a pair of parallel legs, said fastening means including lateral cutouts adapted to engage said prongs whereby the slot is adapted to be squeezed together to snap-fit the lateral cutouts onto and off of said base member.

20. An information display bracket in accordance with claim 19 including a plurality of pairs of cut-outs on the side edges of said lower base section whereby said base member may be adjustably positioned with respect to said mounting base.

21. An information display bracket in accordance with claim 18 wherein said lower base section includes at least one web that projects forwardly of said base member to bear against said crossbar thereby to positively position said base member relative to said support panel and said mounting base.

22. An information display bracket in accordance with claim 18 wherein said proximal end is formed as a first flat triangular proximal arm section with divergent side edges connected to said base member and connected oppositely to said proximal rod end and wherein said distal end is formed as a second flat triangular distal arm section connected to said information display plate and connected oppositely to said distal rod end.

23. An information display bracket in accordance with claim 18 wherein said central rod portion has a plurality of longitudinal reinforcing ribs equidistantly spaced therearound whereby the lateral movement of the display arm is restricted.

24. An information display bracket in accordance with claim 18 including a living hinge structure pivotally interconnecting said base member and said display arm.

* * * * *